US007195025B2

(12) United States Patent
Choi et al.

(10) Patent No.: US 7,195,025 B2
(45) Date of Patent: Mar. 27, 2007

(54) WATERPROOF STRUCTURE OF TENT DOOR AND METHOD FOR FORMING THE SAME

(75) Inventors: Kyong Jai Choi, Pusan (KR); Pat Snyder, Sidney, NE (US); James Louis Gianladis, Sidney, NE (US); Curt Lynn Dinges, Sidney, NE (US)

(73) Assignee: Cabela's, Inc., Sidney, NE (US)

( * ) Notice: Subject to any disclaimer, the term of this patent is extended or adjusted under 35 U.S.C. 154(b) by 217 days.

(21) Appl. No.: 10/758,131

(22) Filed: Jan. 16, 2004

(65) Prior Publication Data

US 2005/0109382 A1 May 26, 2005

(51) Int. Cl.
*E04H 15/58* (2006.01)

(52) U.S. Cl. ..... 135/117

(58) Field of Classification Search ..... 135/117; 24/384, 389, 386, 432; 112/475.16
See application file for complete search history.

(56) References Cited

U.S. PATENT DOCUMENTS 1,665,856 A * 4/1928 Lichten ..... 2/234
2,119,621 A * 6/1938 Ferrone ..... 24/389
2,264,084 A * 11/1941 Loos ..... 24/432
3,417,406 A * 12/1968 Rosenbaum ..... 24/389
3,491,388 A * 1/1970 Bareis ..... 135/117
3,515,426 A * 6/1970 Gerber ..... 135/117
3,561,073 A * 2/1971 Rosser ..... 24/432
3,880,459 A * 4/1975 Kelley ..... 135/117
4,293,957 A * 10/1981 Melarvie ..... 2/2.17
6,651,254 B1 * 11/2003 Chang ..... 2/87
6,668,384 B1 * 12/2003 Chang ..... 24/389
6,675,390 B1 * 1/2004 Chang ..... 24/432
6,691,326 B2 * 2/2004 Hexels ..... 2/457

FOREIGN PATENT DOCUMENTS

WO WO 94/08481 A1 * 4/1994

* cited by examiner

*Primary Examiner*—Tamara L Graysay
(74) *Attorney, Agent, or Firm*—Marsh Fischmann & Breyfogle LLP

(57) ABSTRACT

A first supplementary fabric 117 and a rainwater guiding fabric 118 are equipped between an inner door fabric 112 and a first zipper tape 113 attached to this, and a first waterproof tape 114 is attached on the sewing line of the reverse of the first supplementary fabric 117, so the rainwater that comes into the first zipper tape 113 by thee rainwater guiding fabric 118 can be guided downward to be discharged. And, by attaching a second waterproof tape 104 to the part of the sewing line that is formed when sewing a second supplementary fabric 109 to which an outer door fabric 102 and the second zipper tape 103 attached to this are connected, rainwater can be prevented from penetrating through the sewing line of the outer door fabrics 102. And, by sewing the rainwater discharging fabric 107 together with the bottom zipper tape 119 to the body fabric 101 and then attaching the bottom waterproof tape to the reverse sewing line of the body fabric 101, the rainwater that has penetrated through the bottom sewing line of the first and second zipper tapes 113 and 103 can be guided outward to be discharged.

5 Claims, 7 Drawing Sheets

PRIOR ART

PRIOR ART

PRIOR ART

WATERPROOF STRUCTURE OF TENT DOOR AND METHOD FOR FORMING THE SAME

BACKGROUND OF THE INVENTION

1. Field of the Invention

The present invention relates to a tent, and more specifically to a waterproof structure of tent door and method for forming the same, in which a first supplementary fabric and a rainwater guiding fabric are sewn and equipped between an inner door fabric and a first zipper tape attached to this, and a first waterproof tape is attached to the reverse sewing line of the first supplementary fabric, so that the rainwater flowing into the first zipper tape by a rainwater guiding fabric is guided downward and discharged; and a second waterproof tape is attached to the sewing line part that is formed when sewing a second supplementary fabric to which an outer door fabric and a second zipper tape attached to this are connected, so that rainwater is prevented from penetrating through the sewing line of the outer door fabric; and a rainwater discharging fabric is sewn to the body fabric together with a bottom zipper tape and then a bottom waterproof tape is attached to the reverse sewing line to guide and discharge the rainwater that has penetrated through the bottom sewing line of the first and second zipper tapes, so that rainwater is prevented from penetrating through the door part of the tent.

2. Description of the Related Art

The waterproof structure that is applied to a conventional tent door is shown in FIGS. 1 through 3.

In this tent, the inner and outer door fabrics 12 and 2 are placed in a mutually overlapped condition.

And, to open and close the inner and outer door fabrics 12 and 2, a first zipper tape 13 is sewn and attached to the edge of the inner door fabric 12. The outer edge of the first zipper tape 13 has a plurality of zipper teeth that are extended in a vertical direction (hereinafter to be called vertical zipper teeth) and a plurality of zipper teeth extended in a horizontal direction (hereinafter to be called horizontal zipper teeth).

Also, to the reverse of the outer door fabric 2 is attached by sewing a second zipper tape 3 that corresponds to the first zipper tape 13. The outer edge of the second zipper tape 3 is equipped with a plurality of vertical and horizontal zipper teeth that correspond to the zipper teeth of the first zipper tape 13.

And, to combine or separate the vertical zipper teeth of both zipper tapes 13 and 3, the first and second zipper tapes 13 and 3 are equipped with a vertical slider 4 that can be slid in a vertical direction.

Also, to the body fabric 1 on the lower side of the tent is attached by sewing a bottom zipper tape 6 that corresponds to the bottom end of the first and second zipper tapes 13 and 3.

This bottom zipper tape 6 is equipped with zipper teeth that correspond to the horizontal zipper teeth of the first and second zipper teeth 13 and 3.

And, to combine or separate the horizontal zipper teeth of the first and second zipper tapes 13 and 3 and the zipper teeth of the bottom zipper tape 6, the first and second zipper tape 13 and 3 and the bottom zipper tape 6 are equipped with a horizontal slider 14 that can be slid in the horizontal direction.

Therefore, according to the movement of the vertical slider 4 and the horizontal slider 14, the first zipper tape 13, the second zipper tape 3 and the bottom zipper tape 6 are combined or separated to open or close the door so as to enable access to the inside of the tent.

But, in a conventional tent, as shown in FIG. 2, if rainwater flows into the inner door fabric 12 from the outside of the tent, this rainwater penetrates into the inside of the tent through the part of the sewing line 5 of the inner door fabric 12 and the first zipper tape 13.

Also, even if the vertical zipper teeth formed on the first zipper tape 13 of the inner door fabric 12 and the second zipper tape 3 of the outer door fabric 2 are in a combined condition, rainwater penetrates through the gap of these teeth.

And, as shown in FIG. 3, the rainwater that penetrated through the bottom end of the first and second zipper tapes 13 and 3, while flowing downward to the bottom zipper tape 6 attached to the body fabric 1, passes through the sewing line of the bottom zipper tape 6 and the body fabric 1, or penetrates into the tent through a plurality of the zipper teeth combined with the bottom zipper tape 6.

If so, it can be foreseen that the problem can be easily solved if a waterproof tape is attached to the part of the sewing line that combines respectively the zipper tapes 13, 3 and 6, and the inner door fabric 12, the outer door fabric 2 and the body fabric 1.

However, because a waterproof tape won't be attached to the zipper tapes 13, 3 and 6 due to the quality of the material, any particular solution has not been found so far.

Because a through waterproofing cannot be made in the conventional tent door, it has a problem in that another waterproofing measure has to be taken.

SUMMARY OF THE INVENTION

Therefore, it is an object of the present invention to provide a waterproof structure of the tent door and method for forming the same, in which the rainwater that flows into the first zipper tape attached to the inner door fabric of the tent can be guided downward and discharged out, rainwater can be prevented from penetrating through the sewing line of the outer door fabric, and the rainwater that has penetrated through the bottom sewing line of the first and second zipper tapes is guided outward and discharged, so that rainwater can be thoroughly prevented from penetrating through the door part of a tent.

In one aspect of the present invention, there is provided a waterproof structure of a tent door comprising a first zipper tape attached to an inner door fabric; a second zipper tape that is attached to the outer door fabric placed on the outside of this inner door fabric so as to correspond to the first zipper tape; a vertical slider that combines with or separates from the vertical zipper teeth equipped in the first and second zipper tapes; a bottom zipper tape that is attached to a body fabric corresponding to the first and second zipper tapes; and a horizontal slider that combines or separates the horizontal zipper teeth of the first and second zipper tapes and the zipper teeth of the bottom zipper tape, the waterproof structure comprising: a first supplementary fabric that guides to the bottom of the tent the rainwater that flows in through the sewing line part, a rainwater guiding fabric that is attached closely to said first supplementary fabric and embraces the end of said inner door fabric to form a space portion for guiding rainwater, a first waterproof tape that is attached to the sewing line part of the reverse of the first supplementary fabric so as to waterproof the sewing line part that appears by sewing together one end of said inner door fabric and rainwater guiding fabric and the first supplementary fabric.

In other aspect of the present invention, there is provided a method of forming a waterproof structure for a tent door having a first zipper support tape that is attached to an inner door fabric; a second zipper support tape that is attached to an outdoor fabric placed on the outside of this inner door fabric so as to correspond to the first zipper tape; a vertical slider that combines or separates the vertical zipper teeth equipped in the first and second zipper tapes; a bottom zipper tape that is attached to the body fabric corresponding to the first and second zipper tape; and a horizontal slider that combines or separates the horizontal zipper teeth of the first and second zipper tape and the zipper teeth of the bottom zipper tape, the method comprising the steps of: sewing and attaching one side of the first supplementary fabric to said first zipper tape; folding both end portions of the rainwater guiding fabric to attach the rainwater guiding fabric to the other side of said first supplementary fabric; inserting the inner door fabric between both end portions of said folded rainwater guiding fabric; sewing and attaching one end portion of said rainwater guiding fabric and the inserted inner door fabric to the first supplementary fabric; and attaching the first waterproof tape to the sewing line part that is formed on the reverse of the body fabric to prevent the penetration of rainwater through the sewing line part obtained in said sewing step.

BRIEF DESCRIPTION OF THE DRAWINGS

Other objects and aspects of the present invention will become apparent from the following description of embodiments with reference to the accompanying drawings in which.

DESCRIPTION OF THE PREFERRED EMBODIMENT

Figure 1:
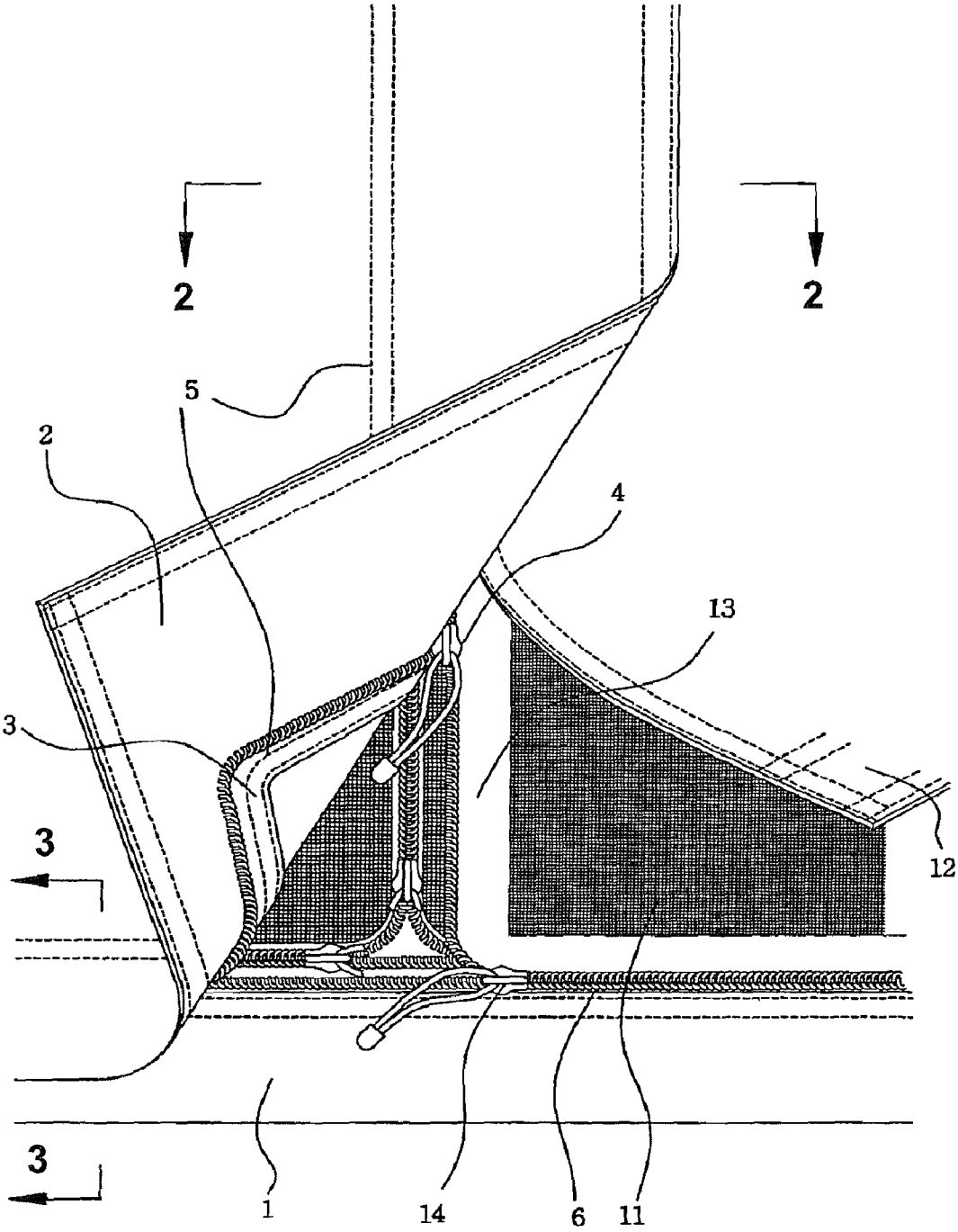
FIG. 1 is a drawing showing the structure of the conventional tent door.
Figure 2:
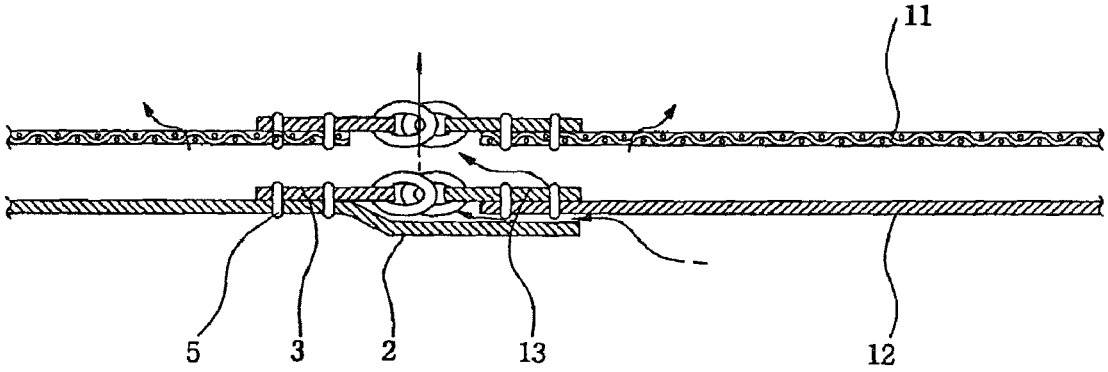
FIG. 2 is an enlarged sectional view along the line 2—2 of the conventional door of FIG. 1.

Hereinafter, the present invention will be described in more detail referring to the drawings.

The construction of a tent door comprises a first zipper tape 113 that is attached to an inner door fabric 112; a second zipper tape 103 that is placed on the outside of the inner door fabric 112 and attached to an outer door fabric 102 so as to correspond to the first zipper tape 113; a vertical slider 106 that combines or separates the vertical zipper teeth equipped on the first and second zipper tape 113 and 103; a bottom zipper tape 119 that is attached to a body fabric 101 corresponding to the first and second zipper tapes 113 and 103; and a horizontal slider 116 that combines or separates the horizontal zipper teeth of the first and second zipper tapes 113 and 103 and the zipper teeth of the bottom zipper tape 119.

According to the upward or downward movement of the vertical slider 106, the vertical zipper teeth equipped on the first and second zipper tapes 113 and 103 are combined or separated. And, according to the left or right movement of the horizontal slider 116, the horizontal zipper teeth equipped on the first and second zipper tapes 113 and 103 and the zipper teeth equipped on the bottom zipper tape 119 are combined or separated. Accordingly, as the door is opened or closed, while the first zipper tape 113, the second zipper tape 103 and the bottom zipper tape 119 are combined or separated according to the movements of the vertical slider 106 and the horizontal slider 116, access to the inside of the tent becomes possible.

To waterproof the tent door part of such a construction, the first zipper tape 113 of the inner door fabric 112 has a first supplementary fabric attached to guide toward the bottom and discharge the outside rainwater that comes in through the part of the sewing line.

Also, in close attachment to the first supplementary fabric 117 is a rainwater guiding fabric 118, both end portions of which embrace the end of the inner door fabric 112, and on the inside of the rainwater guiding fabric 118 is formed a space portion for guiding rainwater downward.

And, to waterproof the sewing line part that appears by sewing together one end of the inner door fabric 112, the rainwater guiding fabric 118 and the first supplementary fabric 117, a first waterproof tape 114 is attached to the sewing line part of the reverse of the first supplementary fabric 117.

Meanwhile, the outer door fabric 102 is additionally equipped with a second supplementary fabric 109 to attach the second zipper tape 103. To prevent rainwater from penetrating into the sewing line part that is formed when sewing this second supplementary 109 on the outer door fabric 102, a second waterproof tape 104 is attached to the sewing line part of the reverse of the outer door fabric 102.

Velcro® (i.e., hook and loop) fasteners 115 and 105 are attached respectively to the inner and outdoor fabrics 112 and 102 to enhance the convenience when opening and closing the door and to combine the indoor and outdoor fabrics 112 and 102 more firmly.

Also, a rainwater discharging fabric 107 is added to discharge out the rainwater that penetrated through the sewing line part on the bottom of the first and second zipper tapes attached to said inner and outer door fabrics 112 and 102. This rainwater discharging fabric 107 is sewn to the bottom of the body fabric 101 together with the bottom zipper tape 119.

The sewing line part of the reverse of the body fabric 101 is additionally attached with a bottom waterproof tape 108 to prevent rainwater from penetrating through the sewing line part that is formed when sewing the rainwater discharging fabric 107.

Below will be described in detail the action of the waterproof structure of the present invention constructed like this.

Figure 4:
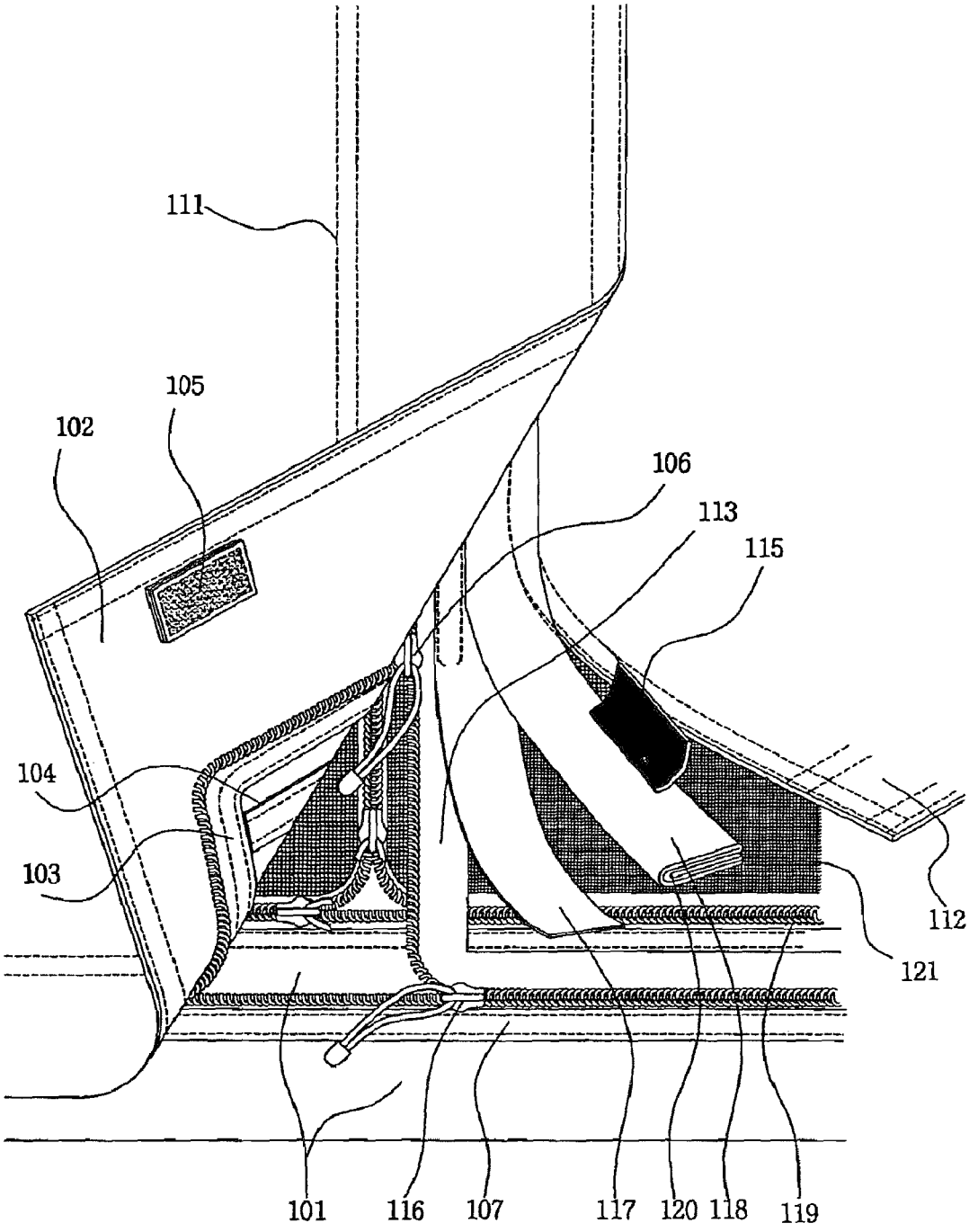
FIG. 4 is a drawing for describing the waterproof structure of the tent door of the present invention and its method.

First, as shown in FIG. 4, the first supplementary fabric 117 is sewn to the first zipper tape 113 on the side of the inner door fabric 112. The first supplementary fabric 117 is sewn supplementarily to secure space for the first waterproof tape 114 to be attached, because the first waterproof tape 114 is not attached to the reverse of the first zipper tape 113.

And, both end portions of the rainwater guiding fabric 118 are attached closely to the first supplementary fabric 117 in a folded condition.

At this time, the inner door fabric 112 is inserted between both end portions of the rainwater guiding fabric 118, and one end portion of the inner door fabric 112 and the rainwater guiding fabric 118 is sewn to the first supplementary fabric 117.

Figure 5:
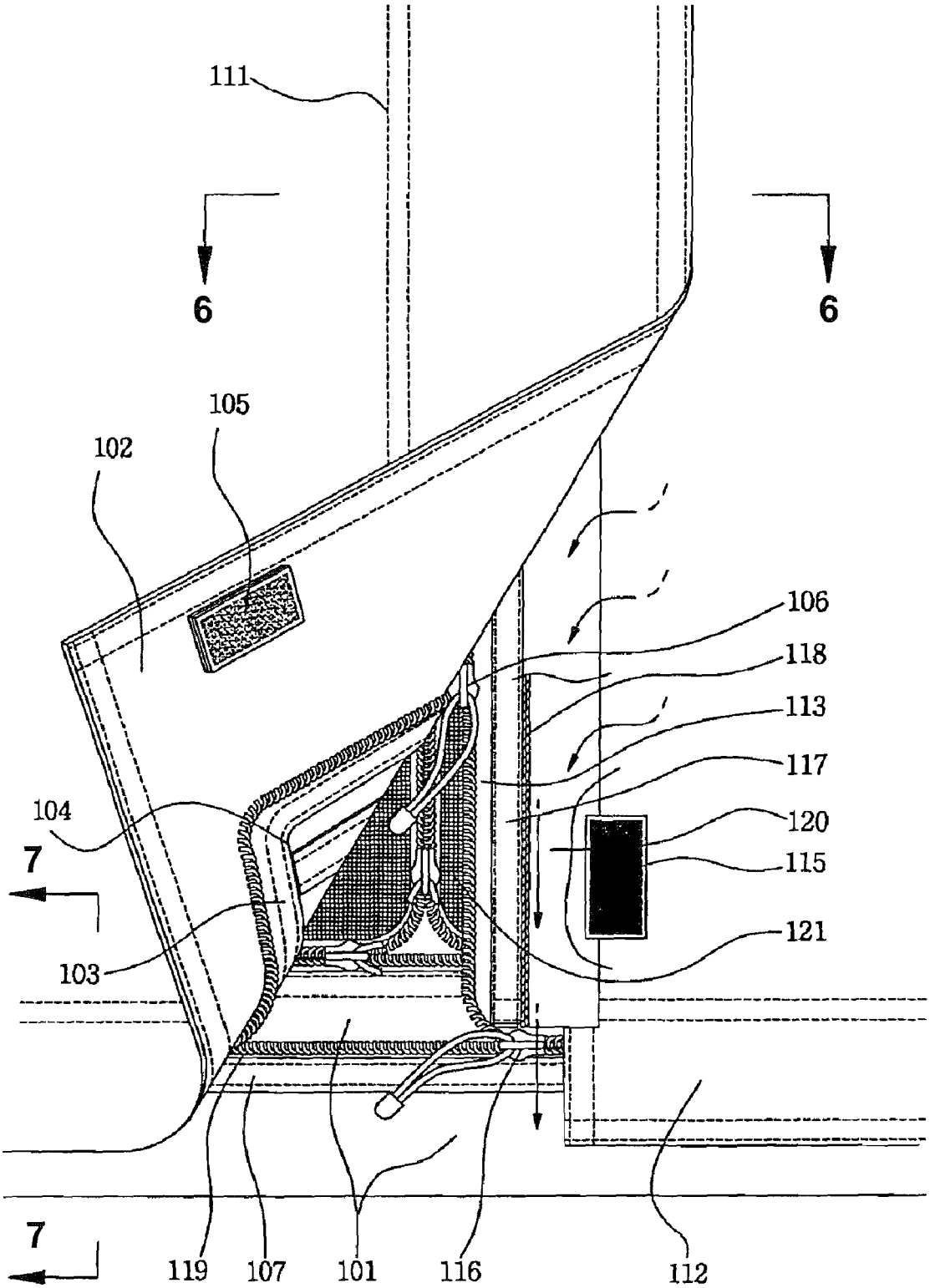
FIG. 5 is a drawing for describing the waterproof action of the tent door of the present invention.

Accordingly, one side of the first supplementary fabric 117 is sewn to the first zipper tape 113, and one end portion of the rainwater guiding fabric 118 is sewn to the other end portion of the first zipper tape 113, as shown in FIG. 5.

And, the first waterproof tape 114 can be easily attached to the sewing line of the reverse of the first zipper tape 113 to which the rainwater guiding fabric 118 is sewn.

Accordingly, if rainwater flows in toward the first zipper tape 113 of the inner door fabric 112, this rainwater is guided to the space portion 120 in contact with the rainwater guiding fabric 118 before it flows downward to be discharged to the ground as shown in FIG. 5.

Since rainwater cannot reach the sewing line of the first supplementary fabric 117 and the first zipper tape 113 due to the rainwater guiding action of the rainwater guiding fabric 118, rainwater can surely be prevented from penetrating.

And, one end portion of the rainwater guiding fabric 118 and the sewing line that sews the inner door fabric 112 and the first supplementary fabric 117 are contacted with rainwater.

However, since the first waterproof tape 114 is attached to the sewing line part of the reverse of the first supplementary fabric 117, rainwater cannot leak into the tent even if it has penetrated.

Accordingly, it is possible to thoroughly block the penetration of the rainwater that flows into the first zipper tape 113 through the inner door fabric 112.

Meanwhile, to the outer door fabric 102 of the present invention is sewn the second zipper tape 103 that has a plurality of zipper teeth for combining with or separating from the vertical zipper teeth of the first zipper tape 113 of the inner door fabric 112.

Because the second waterproof tape 104 cannot be directly attached to the second zipper tape 103 either, a second supplementary fabric 109 is used.

That is, the second zipper tape 103 is sewn to one side of the second supplementary fabric 109 and the outer door fabric 102 is sewn to the other side of the second supplementary fabric 109 for attaching.

Figure 6:
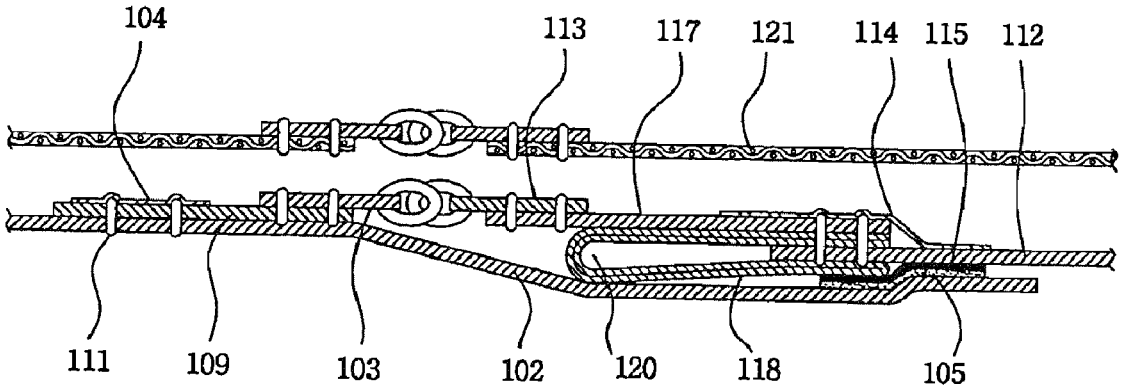
FIG. 6 is an enlarged sectional view along the line 6—6 of the present invention of FIG. 5.

And, the second waterproof tape 104 can be properly attached to the part of the sewing line 111 of the second supplementary fabric 109 and the outer door fabric 102, as shown in FIGS. 4 and 6.

Accordingly, since rainwater cannot penetrate through the sewing line 111 formed on the outer door fabric 102 by the second waterproof tape 104, it is possible to obtain an excellent waterproof effect of the outer door fabric 102.

Meanwhile, the horizontal zipper teeth of the first zipper tape 113 attached to the inner door fabric 112 and the horizontal zipper teeth of the second zipper tape 103 of the outer door fabric 102 combine with or separate from the zipper teeth of the bottom zipper tape 113 sewn to the body fabric 101.

Figure 3:
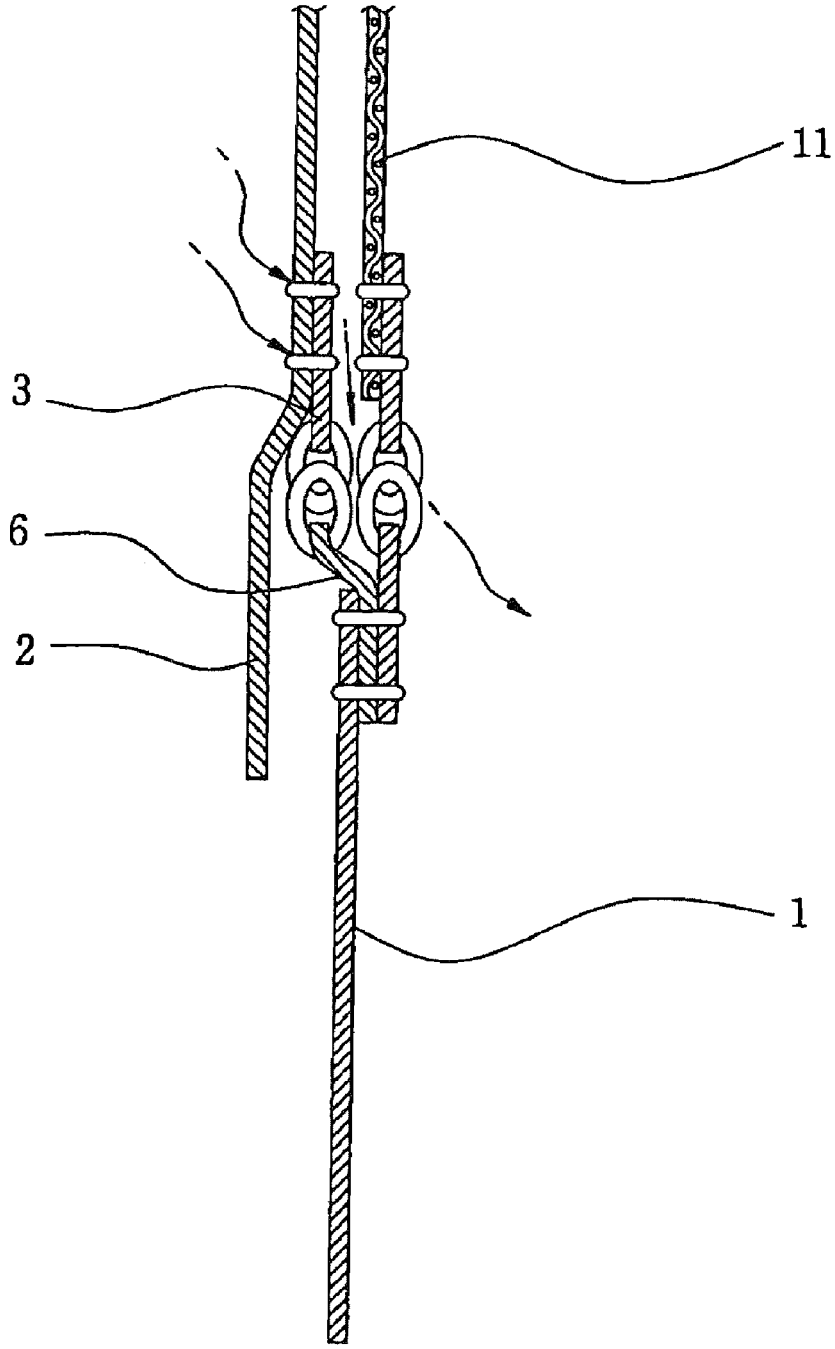
FIG. 3 is an enlarged sectional view along the line 3—3 of the conventional door of FIG. 1.

Conventionally, because the bottom zipper tape 6 was sewn to the body fabric 101 together with the zipper tape of the net fabric 11 as shown in FIG. 3, rainwater penetrated through the sewing line.

But in the present invention, the zipper tape of the net fabric 121 is sewn to the end portion of the body fabric 101, and the bottom zipper tape 119 is sewn together with the rainwater discharging fabric 107 to be attached to the surface of the body fabric 101 at a predetermined interval with the zipper tape.

Figure 7:
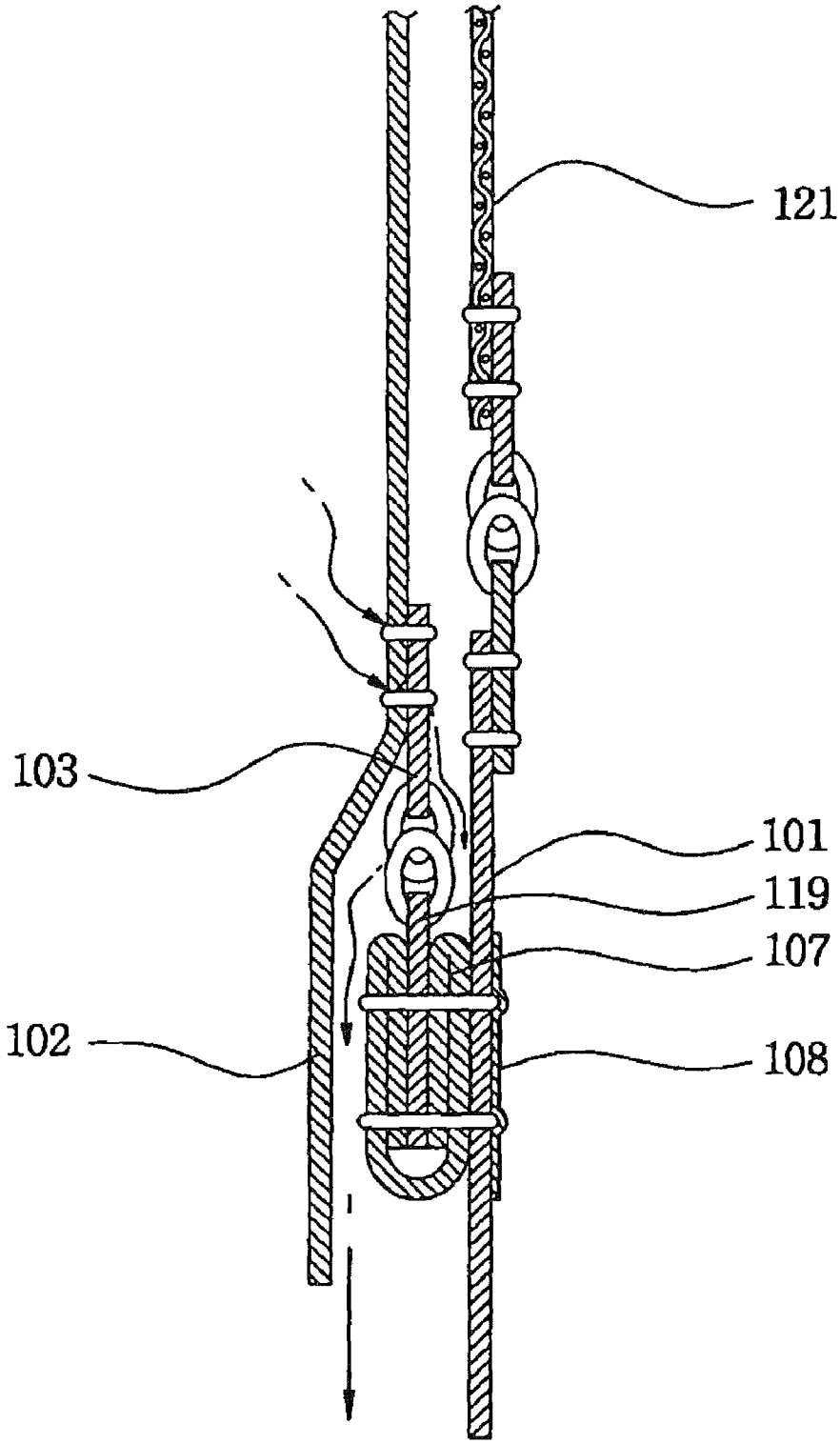
FIG. 7 is an enlarged sectional view along the line 7—7 of the present invention of FIG. 5.

That is, because the bottom waterproof tape 108 is not attached to the zipper tape of the net fabric 121 sewn to the end of the fabric 101, the bottom zipper tape 119 is sewn clear of the zipper tape of the net fabric 121 to attach the bottom waterproof tape 108, as shown in FIGS. 4 and 7.

Accordingly, the bottom waterproof tape 108 can be easily attached to the part of the sewing line of the reverse of the body fabric 101 to which the bottom zipper tape 119 is sewn.

Thus, by attaching the bottom waterproof tape 108, it is possible to surely block the penetration of rainwater through the sewing line of the bottom zipper tape 119.

Meanwhile, it is not possible to attach a waterproof tape to the bottom of the first and second zipper tapes 113 and 103 that are attached to the inner and outer door fabrics 112 and 102.

Accordingly, in the present invention, instead of attaching a waterproof tape, a smooth discharge process makes it possible to discharge rainwater that has penetrated through a sewing line formed on the bottom of the first and second zipper tapes 113 and 103.

That is, the rainwater that has penetrated through a sewing line formed on the bottom of the first and second zipper tapes 113 and 103 passes through between the horizontal zipper teeth of the first and second zipper tapes 113 and 103 and the zipper teeth of the bottom zipper tape 119 to be drained out as shown in FIG. 7.

At this time, the rainwater discharging fabric sewn to the body fabric 101 together with the bottom support tape 119 has its sewing line waterproofed by the bottom waterproof tape 108, so rainwater cannot penetrate through the sewing line of the rainwater discharging fabric 107 and flows out to be discharged.

Next will be described the method for forming the waterproof structure of the tent door according to the present invention having such a construction.

The method for forming the waterproof structure according to the present invention comprises the step in which one side the first supplementary fabric 117 is attached by sewing to the first zipper tape 113; the step in which both end portions of the rainwater guiding fabric 118 are folded to attach the rainwater guiding fabric 118 to the other side of the attached first supplementary fabric 117; the step in which the inner door fabric 112 is inserted between both end portions of the folded rainwater fabric 118; the step in which one end portion of the rainwater guiding fabric 118 and the inserted inner door fabric 112 are sewn and attached to the first supplementary fabric 117; and the step in which the first waterproof tape 114 is attached to the sewing line part formed on the reverse of the body fabric 101 to prevent rainwater from penetrating the sewing line part obtained in the sewing step.

And, it additionally comprises the step in which the second supplementary fabric 109 is sewn to the outer door fabric 102, to attach the second zipper tape 103 to the outer door fabric 102; and the step in which the second waterproof tape 104 is attached to the reverse sewing line part of the outer door fabrics 102, to prevent rainwater from penetrating through the sewing line part that formed when sewing the second supplementary fabric 102.

And, it further comprises the step in which the rainwater discharging fabric 107 is sewn to the bottom of the body fabric 101 together with the bottom zipper tape 119, to discharge out the rainwater that has penetrated through the sewing line part of the first and second support tapes 113 and 103 attached to the inner and outdoor fabrics 112 and 102; and the step in which the bottom waterproof tape 108 is attached to the reverse sewing line part of the body fabric 101, to prevent rainwater from penetrating through the sewing line part that is formed when sewing the rainwater fabric 107.

To see this more closely, in the step of attaching the first supplementary fabric, the length of the first supplementary fabric 117 is cut to a predetermined width and length, and then it is sewn and attached with one end in contact with the first zipper tape 113.

And, in the step of folding the rainwater guiding fabric 118, the fabric cut to a predetermined width and length are folded by half two times, and then one end of the rainwater guiding fabric 118 is made to come into contact with the first supplementary fabric 117 that is obtained in the step of attaching the first supplementary fabric.

Also, in the step of inserting the inner door fabric 112, the inner door fabric 112 is inserted between both end portions of the rainwater guiding fabric 118 that is obtained in the folding step of the rainwater guiding fabric.

And, in the sewing step, one end of the rainwater guiding fabric 118 obtained in the inserting step of the inner door fabric and the inner door fabric 112 are sewn and attached to the first supplementary fabric 117.

Also, in the step of attaching the first waterproof tape, the first waterproof tape 114 is attached to the sewing line part formed on the reverse of the body fabric 101, so as to prevent rainwater from penetrating through the sewing line part that is obtained in the sewing step.

Thus, by sewing the rainwater guiding fabric 118 and the inner door fabric 112 simultaneously to the first supplementary fabric 117 attached to the first zipper tape 113, it is possible to prevent rainwater from penetrating in the direction of the inner door fabric 112 and improve the workability as well.

And, in the step of sewing the second supplementary fabric, the second supplementary fabric 109 cut to a predetermined width and length is sewn to fit the outer door fabric 102 so as to attach the second zipper tape 103 to the outer door fabrics 102.

Also, in the step attaching the second waterproof tape, the second waterproof tape 104 is attached to the sewing line part of the reverse of the outdoor fabric 102, so as to prevent rainwater from penetrating through the sewing line that is formed when, sewing the second supplementary fabric 109 in the sewing step of the second supplementary fabric. Accordingly, it is possible to prevent rainwater from penetrating through the sewing line 111 of the outer door fabric 102.

Meanwhile, in the step of sewing the rainwater discharging fabric, the rainwater discharging fabric 107 is sewn to the bottom of the body fabric 101 together with the bottom zipper tape 119 to discharge out the rainwater that has penetrated through the sewing line part of the first and second support tapes 113 and 103 that combine the zipper teeth attached to the bottom of the indoor and outdoor fabrics 112 and 102 and the zipper teeth of the bottom zipper tape 119 attached to the body fabric 101.

And, in the step of attaching the bottom waterproof tape, the bottom waterproof tape 108 is attached to the sewing line part of the reverse of the body fabric 101, so as to prevent rainwater from penetrating through the sewing line part that is formed when sewing the rainwater discharging fabric 107 in the sewing step of the rainwater discharging fabric. Accordingly, it is possible to prevent rainwater from penetrating through the sewing line of the bottom zipper tape 119 sewn to the body fabric 101.

Thus, the present invention can guide downward and discharge out the rainwater that flows into the first zipper tape attached to the inner door fabric of the tent, prevent rainwater from penetrating through the sewing line of the outdoor fabric, and thoroughly block the penetration of rainwater through the door part of the tent, by guiding and discharging out the rainwater that has penetrated through the bottom sewing line of the first and second zipper tapes.

What is claimed is:

1. A tent door comprising:

a first zipper tape attached to an inner door fabric via a first supplemental fabric;

a second zipper tape attached to an outer door fabric so as to correspond to the first zipper tape;

a vertical slider that combines or separates zipper teeth of the first and second zipper tapes, wherein a portion of the outer door fabric extends over the first and second zipper tapes when the zipper teeth are engaged;

a rainwater guiding fabric having first and second ends disposed on opposing sides of an end of said inner door fabric, wherein said rainwater guiding fabric forms a space between said first and second ends for guiding rainwater, a first waterproof tape that is attached to a sewing line part of the reverse of the first supplementary fabric so as to waterproof the sewing line part that is formed by sewing together the end of said inner door fabric and rainwater guiding fabric and the first supplementary fabric.

2. The tent door of claim 1, further comprising a second supplementary fabric that attaches the second zipper tape to the outer door fabric, and a second waterproof tape that is attached to a sewing line part of the reverse of the outer door fabric so as to prevent rainwater from penetrating through the sewing line that is formed when sewing said second supplementary fabric to the outer door fabric.

3. The tent door of claim 1, wherein the first and second ends of said rainwater guiding fabric are sewn to opposing sides of said end of said inner door fabric.

4. A method of forming a tent door having a first zipper support tape that is attached to an inner door fabric; a second zipper support tape that is attached to an outer door fabric placed on the outside of this inner door fabric so as to correspond to the first zipper tape; a vertical slider that combines or separates vertical zipper teeth equipped in the first and second zipper tapes; the method comprising the steps of:

attaching one side of a first supplementary fabric to said first zipper tape;

folding first and second end portions of a rainwater guiding fabric to form a space between said first and second ends of the the rainwater guiding fabric;

inserting an end of the inner door fabric between the first and second end portions of said folded rainwater guiding fabric;

sewing at least one end portion of said rainwater guiding fabric and the inserted inner door fabric to the first supplementary fabric; and attaching a first waterproof tape to a sewing line part that is formed on the reverse of the first supplemental fabric to prevent the penetration of rainwater through the sewing line part obtained in said sewing step.

5. The method of claim 4, further comprising the steps of:

sewing a second supplementary fabric to the outer door fabric to attach the second zipper tape to said outer door fabric; and attaching a second waterproof tape to a second sewing line part of the reverse of the second supplementary fabric to prevent rainwater from penetrating through the second sewing line part that is formed when sewing said second supplementary fabric.

* * * * *

UNITED STATES PATENT AND TRADEMARK OFFICE

CERTIFICATE OF CORRECTION

PATENT NO. : 7,195,025 B2
APPLICATION NO. : 10/758131
DATED : March 27, 2007
INVENTOR(S) : Choi et al.

It is certified that error appears in the above-identified patent and that said Letters Patent is hereby corrected as shown below:

Column 8
Line 57, delete the second occurrence of "the".

Signed and Sealed this

Fifteenth Day of May, 2007

JON W. DUDAS
*Director of the United States Patent and Trademark Office*